United States Patent [19]

Hepp

[11] Patent Number: 4,873,636

[45] Date of Patent: Oct. 10, 1989

[54] INTERPRETATION OF CONICAL STRUCTURES FROM DIPMETER SURVEYS

[75] Inventor: Vincent R. Hepp, Houston, Tex.

[73] Assignee: Amoco Corporation, Chicago, Ill.

[21] Appl. No.: 113,844

[22] Filed: Oct. 26, 1987

[51] Int. Cl.[4] ..... G01V 3/18

[52] U.S. Cl. ..... 364/422

[58] Field of Search ..... 364/422

[56] References Cited

U.S. PATENT DOCUMENTS 4,357,660 11/1982 Hepp ..... 364/422

OTHER PUBLICATIONS

"The Use of Dipmeter Synthetic Data To Determine Rock Texture and Depositional Environment", Eric Standen, Canadian Well Logging Society Formation Symposium (10th: Calgary) Trans. Paper AA, 1985.

"A Mathematical Model for Orientation Data from Macroscopic Coniral Folds", D. Iceller et al., Mathematical Geology, vol. 14, No. 4,1982.

*Primary Examiner*—Jerry Smith

*Assistant Examiner*—Gail O. Hayes

*Attorney, Agent, or Firm*—Scott H. Brown; Fred E. Hook

[57] ABSTRACT

A method as disclosed of assisting in the determination of the existence of conical folding of the geological formation utilizing an existing dipmeter survey obtained through a wellbore penetrating the geological formation. Estimates of plunge and aperture of the geological formation, as well as the position of the wellbore with respect to the geologic formation are made. These estimates are utilized to generate a synthetic dip plot representative of conical folding. The synthetic dip plot is compared to the existing dipmeter survey, and one or more of the estimates are varied to obtain a final synthetic dip plot that has the highest correlation of the dipmeter survey, thereby providing an assistance in the determination of existence of conical folding of the geological formation.

9 Claims, 5 Drawing Sheets

DIPMETER RESULTS PLOT
STACKED CONED XW=1.025, YW=0.0125, PL=8.5, AP=11.5, POS + NEG

DIPMETER RESULTS PLOT

STACKED CONES XW=1.025, TW=0.0125, PL=8.5, AP= 11.5, POS+NEG

INTERPRETATION OF CONICAL STRUCTURES FROM DIPMETER SURVEYS

BACKGROUND OF THE INVENTION

1. Field of the Invention

The present invention relates to a method of detecting conical folding in geological formations and, more particularly, to such a method which utilizes an existing dipmeter survey in conjunction with one or more synthetic dip plots.

2. Setting of the Invention

The existence of conical folding of geological formations has been debated within the geological community for many years; however, it is now generally accepted that subterranean geological formations can be folded and folded in such a manner to either be cylindrical or conical in general shape. One way to visualize conical folding is a plurality of cups that have been nested with an essentially horizontal plane passing through the center axis of each of the cups.

During the exploration for oil and gas, wellbores are drilled through the geological formations, and oftentimes various forms of logging tools are used to determine certain parameters of the geological formations. One such logging method is called a dipmeter survey, which is well known to those skilled in the art. A dipmeter survey provides an indication of the inclination and direction of each geological formation. As dipmeter surveys are becoming more widely used in the exploration for oil and gas, it has been observed that certain distinctive patterns appear on dipmeter surveys. Upon later analysis of these distinctive patterns, it has been found that some of these can be related to, i.e., are caused by, cylindrical or conical folding of the geological formations. Due to the migration effect of the oil and gas, it is desired for the wellbore to penetrate the geological formations at the apex or uppermost portion of each of the geological formations, and a dipmeter survey assists in the location of such desired apex.

With conical folding, the location of this apex is uncertain. There is a need within the industry for a method of determining the existence of conical folding within geological formations from a dipmeter survey such that one skilled in the art, upon review of a dipmeter survey, can determine the existence of conical folding with greater confidence.

A good description of conical folding and the resulting dipmeter tangent diagrams are discussed in "Structural Uses of Tangent Diagrams" by Bengtson in *Geology*, Vol. 8, p. 599–602, December 1980, which is incorporated herein by reference. Within the Bengtson article, cylindrical and conical folding are described, as well as tangent diagrams of the dip data are shown. In Bengston conical folding is assumed and the tangent plots are provided. There is no disclosure or suggestion within Bengston of first obtaining a dipmeter plot and then producing synthetic dipmeter plots and comparing the two to determine if indeed conical folidng is present. Further, there is no disclosure or suggestion within Bengston of using any other type of dipmeter plot other than the tangent diagrams.

SUMMARY OF THE INVENTION

The present invention has been contemplated to meet the above-described needs; specifically, the present invention provides a method of assisting in the determination of the existence of conical folding of a geological formation. In the method, an existing dipmeter survey is obtained through a wellbore that penetrates the geological formation. Estimates of the plunge and aperture of the geological formation are obtained and the position of the wellbore with respect to the geological formation is estimated. Utilizing these estimates, a synthetic dip plot representative of conical folding is generated. The generated synthetic dipmeter plot is compared to the dipmeter survey, and it is determined whether or not additional adjustment of the input estimates needs to be made to obtain a final synthetic dip plot that has the highest correlation to the dipmeter survey. Thereafter, the log analyst, optionally with the assistance of a computer, can review the dipmeter survey and the highest correlation dip plot to determine if there is sufficient correlation between the two to indicate that the dipmeter survey is obtained through a formation that exhibits conical folding.

DETAILED DESCRIPTION OF THE PREFERRED EMBODIMENT

The present invention provides a method of assisting in the determination of the existence of conical folding of a geological formation utilizing an existing dipmeter survey that has been obtained through a wellbore penetrating the geological formation. In the method, estimates are obtained of plunge and aperture of the geological formation, as well as an estimate of the position of the wellbore with respect to the geological formation. Utilizing these estimates, a synthetic dip plot is generated representative of conical folding. This process is continued and the value of one or more of the estimates is adjusted to obtain a final synthetic dip plot that has the highest correlation to the dipmeter survey, thereby providing an assistance in the determination of the existence of conical folding of the geological formation.

A study of folded formations is an important feature of the seach for oil and gas. One important tenet is the conservation of volume or "space-making concept." As rocks are folded, their density tends to remain constant and a corollary is that the thickness, i.e., the distance from foot to wall of a seam measuring normally to the bedding, tends to remain constant. This constraint limits the range of mathematical surfaces that may describe folded beds. For instance, concentric cylinders increase in thickness towards their center of curvature or decrease outwardly to conserve bed volume. However, with conically folded formations the beds can be folded as equal cones of constant curvature, separated by constant thickness, if a translation is allowed along their common axes. In other words, a longitudinal slippage of each bed with respect to its upper and lower neighbors is permitted. Such conical folding has been described by numerous articles and is well known to those skilled in the art.

To assist in identifying the existence of conical folding, the following mathematical principles can be involved. Many families of surfaces can be described by equation of the type:

$$F(x,y,z\lambda)=0$$

where x, y and z represent the three-dimensional coordinates of a point on one member surface of the family, while λ is a real number characteristic of that member. Second degree polynomials can be representative of curved surfaces, such as are often suggested by forms found in nature, such as conically folded geological formations in particular.

Mathematically, if one assumes that bed boundaries (geological formations) constitute a family of surfaces $F(x,y,z,\lambda)=0$, the dip at any point (x,y,z) is a vector composed of the first derivatives of F along the x-, y- and z-directions. Thus, given F and the course of the wellbore, one can derive a synthetic dipmeter survey. The parameter λ can be the depth along the well or related to it.

Figure 1:
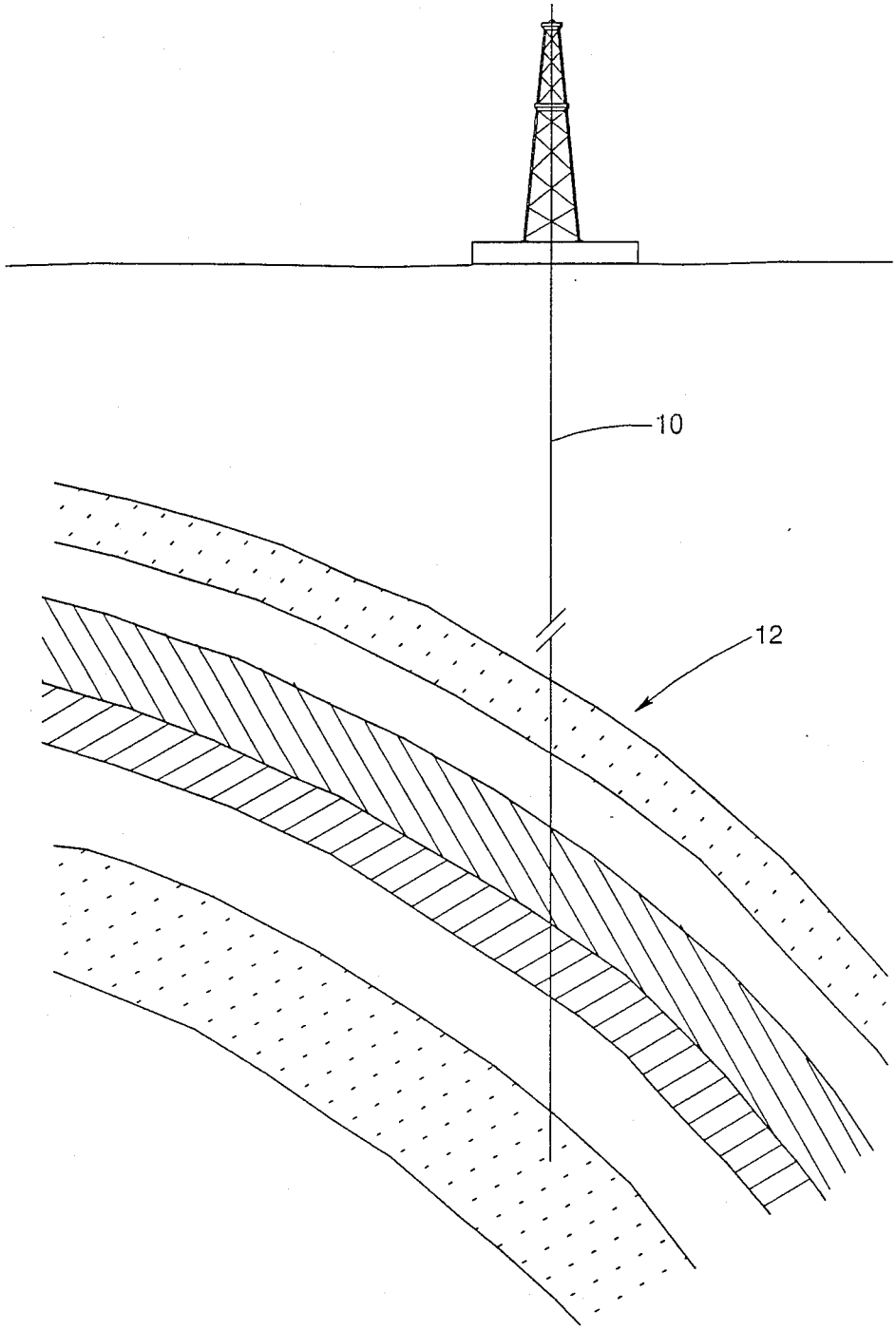
FIG. 1 is a elevational view of a wellbore penetrating a plurality of geological formations, which have been conically folded.
Figure 2A:
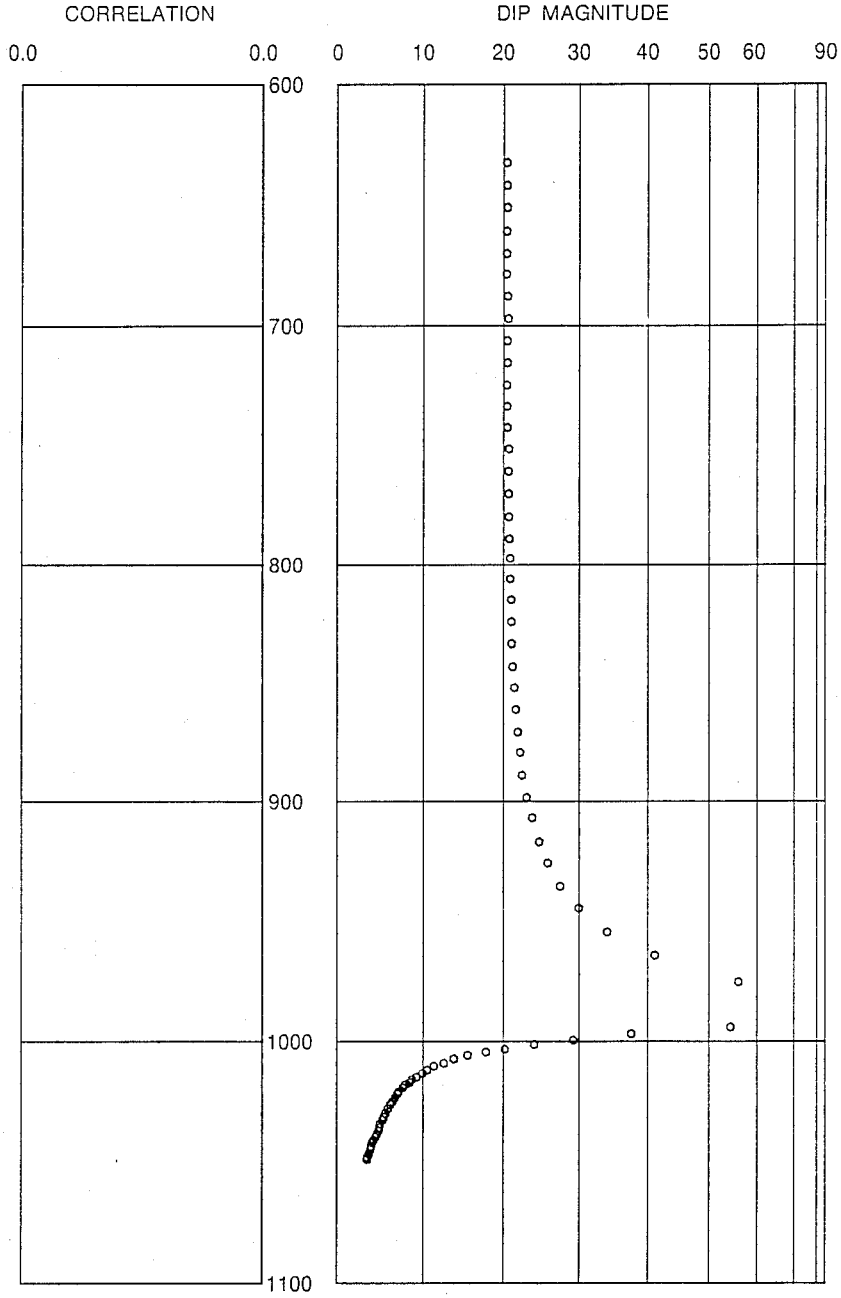
FIG. 2*a* is a dipmeter tadpole plot from a conically-folded formation.
Figure 2B:
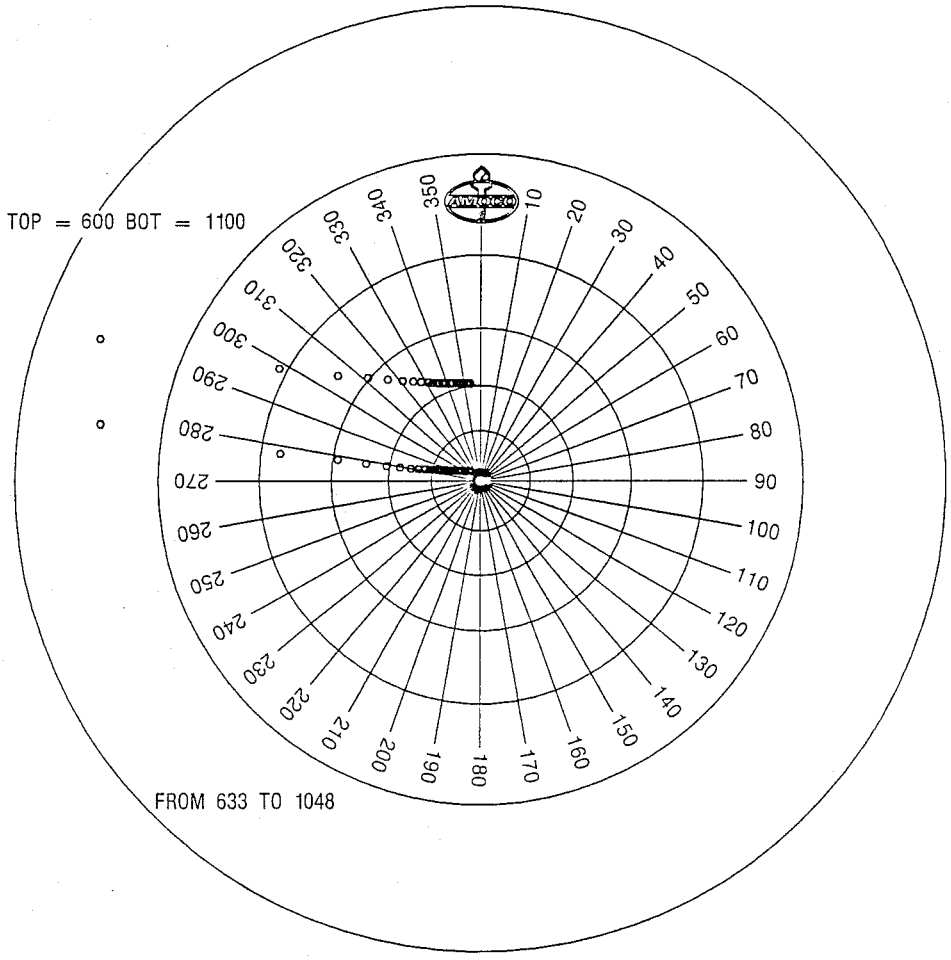
FIG. 2*b* is a dipmeter tangent plot from a conically-folded formation.

As shown in FIG. 1, a wellbore 10 is penetrating a plurality of geological formations 12 which may have been conically folded. FIGS. 2*a* and 2*b* illustrate dipmeter plots that would have been obtained from a portion of the wellbore 10 shown in FIG. 1. In FIG. 2*a*, a conventional tadpole dip plot is shown, and in FIG. 2*b*, a tangent or numeric plot is shown . The plots of FIGS. 2*a* and 2*b* are derived from exact second degree polynomial expressions. In FIG. 2*b*, a distinctive plot is obtained that, when viewed by one skilled in the art, one would recognize as being caused by a conically-folded geological formation. However, in the real world with real plots, conically-folded formations are extemely difficult to detect as the plots do not have such simple curves, as shown in FIGS. 2*a* and 2*b*. This is true because second degree polynomials only can approximate complex mechanical interactions of folding, natural irregularities exist in the bedding, and irregularities exist in the borehole and dipmeter surveys. Therefore, there is a need for a method of assisting a log analyst in determining the existence of conical folding from obtained dipmeter surveys, either of the tadpole type or the tangent plot type.

Figure 3:
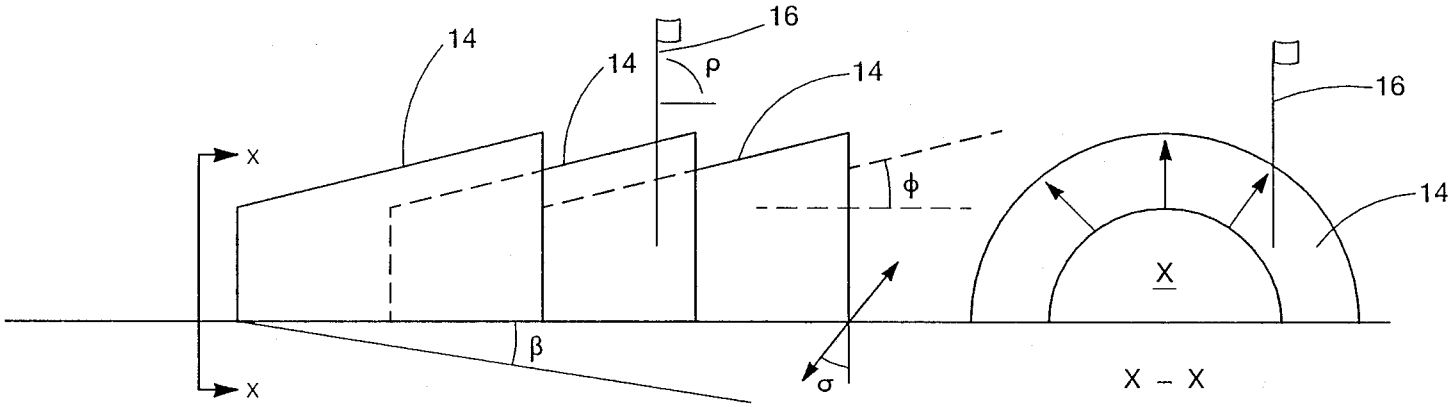
FIG. 3 is a diagrammatic side elevational view of nested cones representing conically folded geological formations penetrated by a wellbore.

To better understand the present invention, FIG. 3 is provided, showing a side elevation view of a plurality of nested cones 14. Each cone 14 is thought of as a geological formation in a plunging anticlinal configuration. Please note the constant thickness of the free space between the cups. The inclination or plunge of the stacked cups from a true horizontal plane is indicated by the angle $\beta$, the rolling or crosswise tilting of the cones from a horizontal plane is represented by the angle $\alpha$, and the aperture (one-half of the angle of the opening of the cone) is represented by $\phi$.

A wellbore 16 penetrates the cones 14 at an angle $\rho$ from the vertical plumb line. Using as inputs, the cone aperture and plunge on a common axis, and the location of the well, with the apex assumed to be at the origin or the coordinates, a quadratic equation is solved at the depths of the two penetration points in the cone 14. Taking advantage of the mathematical simplicity of a conical structure, the synthetic dip magnitude can be determined from these two points. By varying the location of the cone apex along the plunging axis and generating penetration points and dips at each point, an output is recorded which can be used by conventional dipmeter plotting programs to produce dip plots, of the type shown in FIGS. 2*a* and 2*b*.

Figure 4:
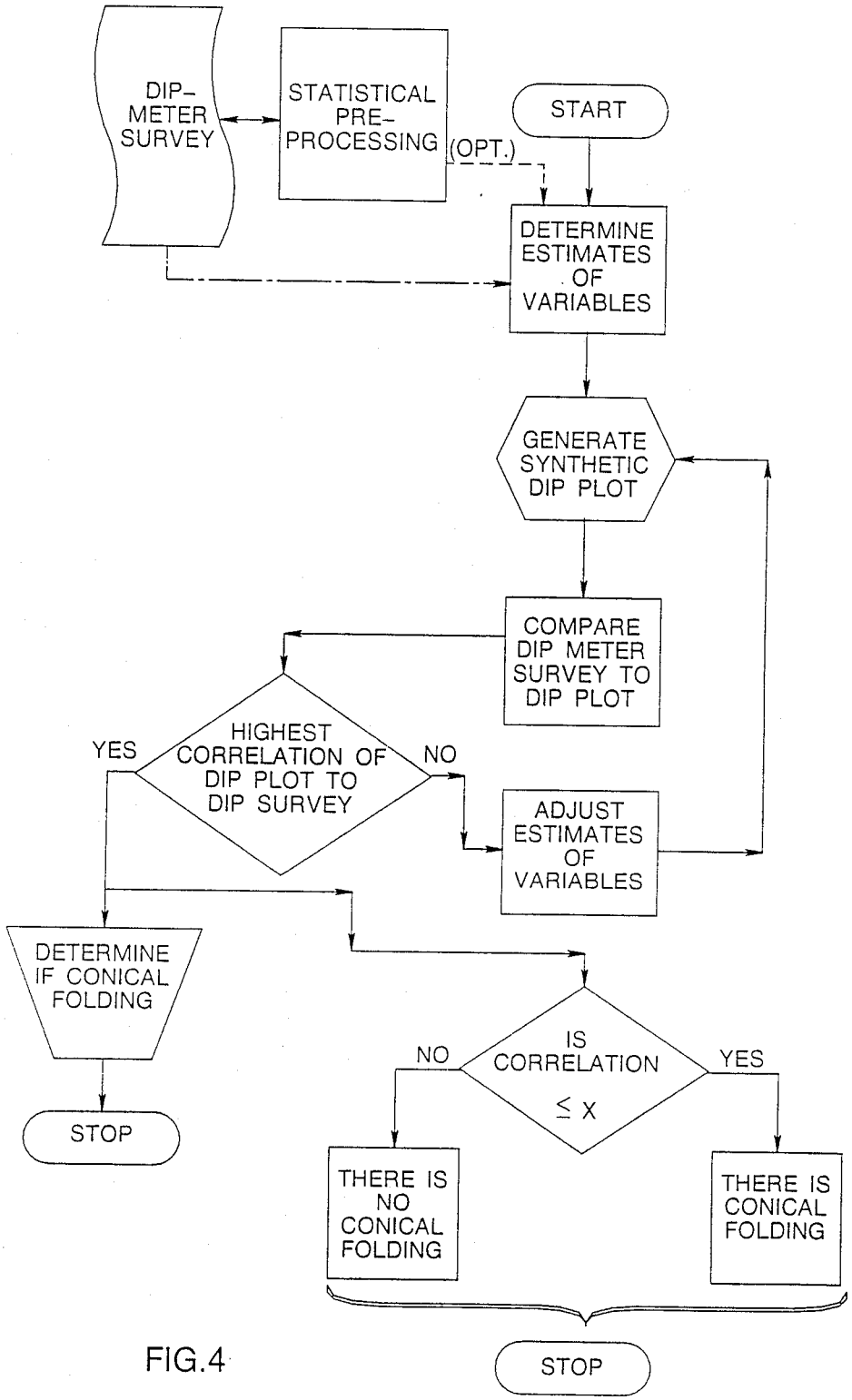
FIG. 4 is block flow diagram of one method of the present invention.

Utilizing the above understanding, one method of the present invention will be described. The method can be performed solely by a log analyst or, preferably, with the assistance of a programmable digital computer. As shown in FIG. 4, a dipmeter survey is first obtained, as is well known in the art, and then the log analyst obtains the first estimates of the variables, such as the cone aperture, the plunge off of the common axis, and the best estimate of the location of the well with respect to the axis of the conically folded geological formation that it penetrates. Optionally, some statistical preprocessing of the dipmeter data from the dipmeter survey can be utilized to obtain a better estimate of the variables. Such optional preprocessing can involve covariance analysis using eigen vectors and eigen values, wherein one eigen vector indicates an initial guess of the probable axis of the cone and the associated eigen value provides the aperture of the cone. Such statistics will actually represent complete conical structures. However, in nature, only partial embodiments of conical structures can be found, hence the need for the initial estimations.

After an estimate of the variables have been made, a synthetic dip plot is generated using the mathematical principles described above, indicative of conical folding. Either visually or with the assistance of the programmable-digital computer, optical scan devices, or the like, a correlation is made between the dipmeter survey and the synthetic dip plot. If it is determined that a better correlation can be made, then one or more of the variables are adjusted to generate a new synthetic dip plot. It has been found that the synthetic dip plot is most sensitive to the changing in the estimation of the well location; therefore, it is preferable that the estimate of well location be varied first to try to obtain the highest correlation prior to changing the estimates of plunge and/or aperture. After generating a plurality of dip plots and comparing those dip plots to the dip survey, it is finally determined that no greater correlation can be obtained between the dip plot and the dip survey.

Another valid measure of correlation is the well known Pearson Product Moment, which can be expressed as $$R = \frac{1}{N} \sum_{i=1,N}^{N} u_{log(i)} \cdot u_{model(i)},$$

where $\bar{u}_{log(i)}$ is the ith unit dip vector read from the log and $\bar{u}_{model(i)}$ is the ith unit dep vector from the model. This number can and should approach the value of 1.0.

After the highest correlation of the dip plot to the dip survey is obtained, as determined by visual reference or comparing correlation values, the log analyst, alone or in conjunction with the programmable digital computer, determines if conical folding is present. One method of determining if there is conical folding is a linear fit on the tangent plot (FIG. 2*b*) such that if the correlation value is higher or lower than a preset number, then there either is or is not conical folding. Another method is using covariance analysis where a plane passes through the cone and statistical analysis of the deviation from the cone plane is used as an assistance to determine if there is conical folding or not.

With the present method, the log analyst can review a dipmeter survey, and if the log analyst is unsure as to whether or not there is or is not conical folding, he or she can very easily generate one or more synthetic dip plots which can be utilized for comparison purposes to determine whether there is or is not conical folding.

Wherein the present invention has been described in a particular relation to the drawings attached hereto, it should be understood that other and further modifications, apart from those shown or suggested herein, may be made within the scope and spirit of the present invention.

I claim:

1. A method of assisting in the determination of the existence of conical folding of a geological formation utilizing an existing dipmeter survey obtained through a wellbore penetrating the geological formation, comprising:

(a) obtaining estimates of plunge and aperture of the geological formation, and position of the wellbore with respect to the geological formation;

(b) utilizing the estimates, generating a synthetic dip plot representative of conical folding;

(c) adjusting the value of one or more of the estimates to obtain a final synthetic dip plot that has the highest correlation of the dipmeter survey, thereby providing an assistance in the determination of the existence of conical folding of the geological formation.

2. The method of claim 1 wherein step (a) comprises statistically analyzing the dipmeter survey to obtain the estimates of plunge and aperture of geologic formation.

3. The method of claim 2 wherein the statistical analyzing comprises utilizing covariance analysis to obtain the estimates of aperture and plunge.

4. The method of claim 1 wherein synthetic dip plot is a dipmeter tadpole plot.

5. The method of claim 1 wherein the synthetic dip plot is a tangent plot.

6. The method of claim 1 wherein in step (c) the estimate of wellbore location is varied first.

7. The method of claim 1 wherein step (c) comprises adjusting the value of one or more of the estimates to generate a new synthetic dip plot, determining if the correlation increases or decreases, and adjusting one or more of the values to increase the correlation, and adjusting one or more of the remaining estimates to obtain a final synthetic dip plot that has the highest correlation to the dipmeter survey.

8. The method of claim 7 including generating a correlation number used to determine the existence of conical folding.

9. The method of claim 8 wherein the correlation number is determined utilizing linear regression, covariance analysis, or Pearson Product Moment.

* * * * *

UNITED STATES PATENT OFFICE
CERTIFICATE OF CORRECTION

PATENT NO. : 4,873,636

DATED : October 10, 1989

INVENTOR(S) : Vincent R. Hepp

It is certified that error appears in the above-identified patent and that said Letters Patent is hereby corrected as shown below:

Column 2, line 54, "seach" should read --search--.

Column 3, line 9, equation "$F(x,y,z\lambda)=0$" should read --$F(x,y,z,\lambda)=0$--.

Column 4, line 53, in the equation, "${}^{u}\log_{(i)}$" should read--${}^{\bar{u}}\log_{(i)}$--.

Column 4, line 53, in the equation,"${}^{u}\text{model}_{(i)}$" should read--${}^{\bar{u}}\text{model}_{(i)}$--.

Signed and Sealed this

Fifteenth Day of May, 1990

*Attest:*

HARRY F. MANBECK, JR.

*Attesting Officer*

*Commissioner of Patents and Trademarks*